US005992929A

United States Patent [19]

Liu

[11] Patent Number: 5,992,929

[45] Date of Patent: Nov. 30, 1999

[54] FOLDING COLLAPSIBLE ROCKING CHAIR

[76] Inventor: Lausan Chung-Hsin Liu, No. 243, Chein-Kuo Rd., Taipei Hsien, Taiwan

[21] Appl. No.: 09/197,518

[22] Filed: Nov. 23, 1998

[51] Int. Cl.[6] ..... A47C 3/029

[52] U.S. Cl. ..... 297/33; 297/272.1

[58] Field of Search ..... 297/32, 33, 272.1

[56] References Cited

U.S. PATENT DOCUMENTS 297,809 4/1884 Jones ..... 297/32
715,346 12/1902 Brubaker ..... 297/33
890,192 6/1908 Stombaugh ..... 297/32
3,114,572 12/1963 Hopkins ..... 297/33

*Primary Examiner*—Anthony D. Barfield
*Attorney, Agent, or Firm*—Bacon & Thomas

[57] ABSTRACT

A folding collapsible rocking chair includes a chair, two side frame sets at two opposite lateral sides of the chair, and two rockers at the bottom side of the side frame sets, the chair, the side frame sets and the rockers being pivoted to one another so that the rocking chair can be folded up and collapsed when not in use.

2 Claims, 5 Drawing Sheets

FOLDING COLLAPSIBLE ROCKING CHAIR

BACKGROUND OF THE INVENTION

The present invention relates to rocking chairs, and more particularly to a folding collapsible rocking chair.

A rocking chair is a chair on rockers that can be moved backwards and forwards. Regular rocking chairs are commonly made of wooden material, and the related parts are fixedly connected to one another by fastening means or joints. These rocking chairs occupy much space.

SUMMARY OF THE INVENTION

It is the main object of the present invention to provide a rocking chair which is folding collapsible. According to one aspect of the present invention, the folding collapsible rocking chair comprises a chair, two side frame sets at two opposite lateral sides of the chair, and two rockers at the bottom side of the side frame sets, the chair, the side frame sets and the rockers being pivoted to one another so that the rocking chair can be folded up and collapsed when not in use. According to another aspect of the present invention lock means is provided to lock the folding collapsible rocking chair in the operative position.

DETAILED DESCRIPTION OF THE PREFERRED EMBODIMENT

Figure 1A:
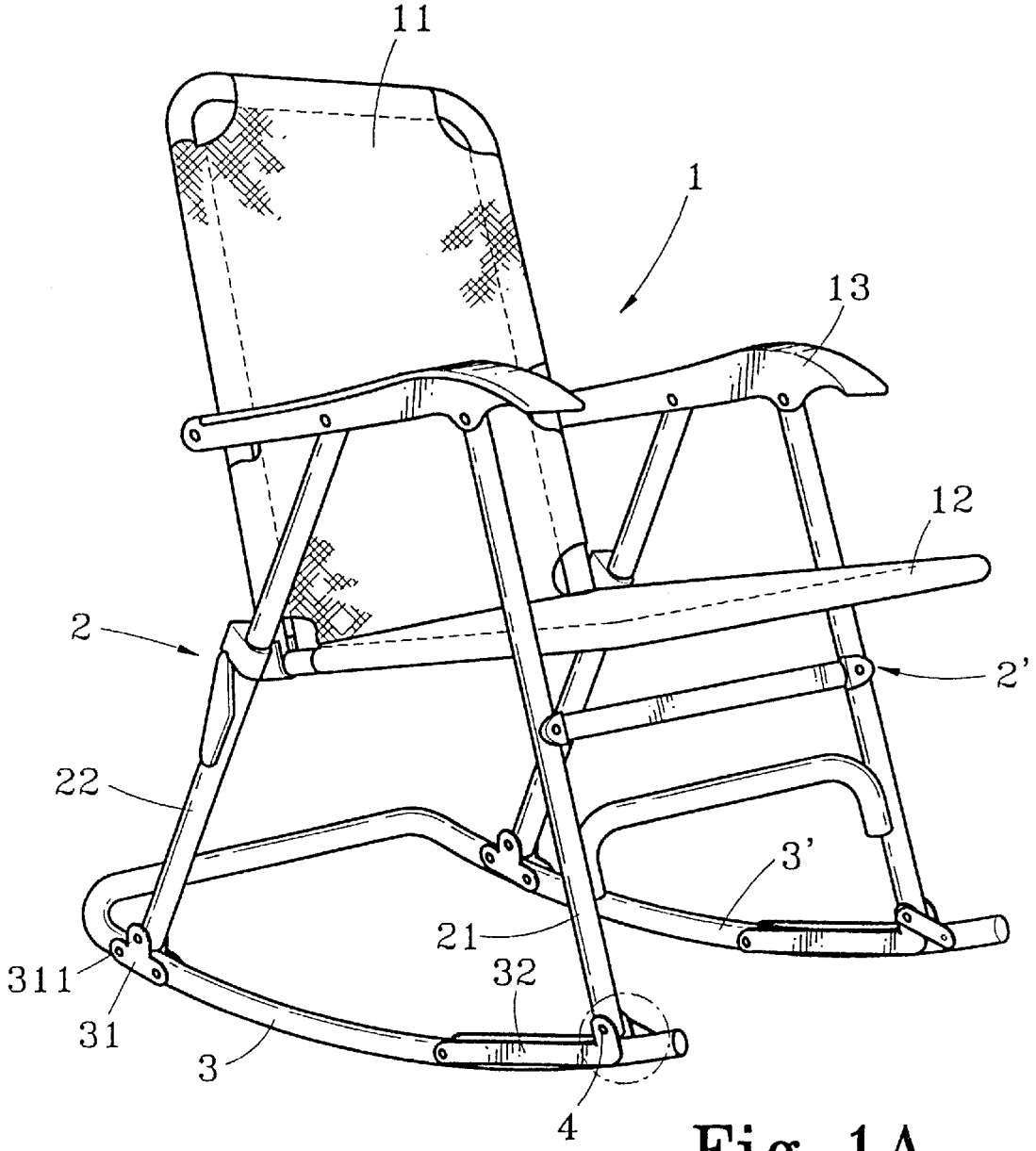
FIG. 1A is a perspective view of a folding collapsible rocking chair according to the present invention.
Figure 1B:
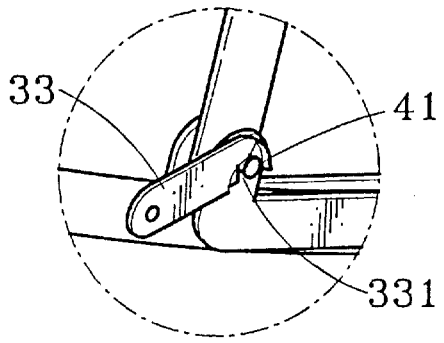
FIG. 1B is an enlarged view of a part of FIG. 1A.
Figure 2:
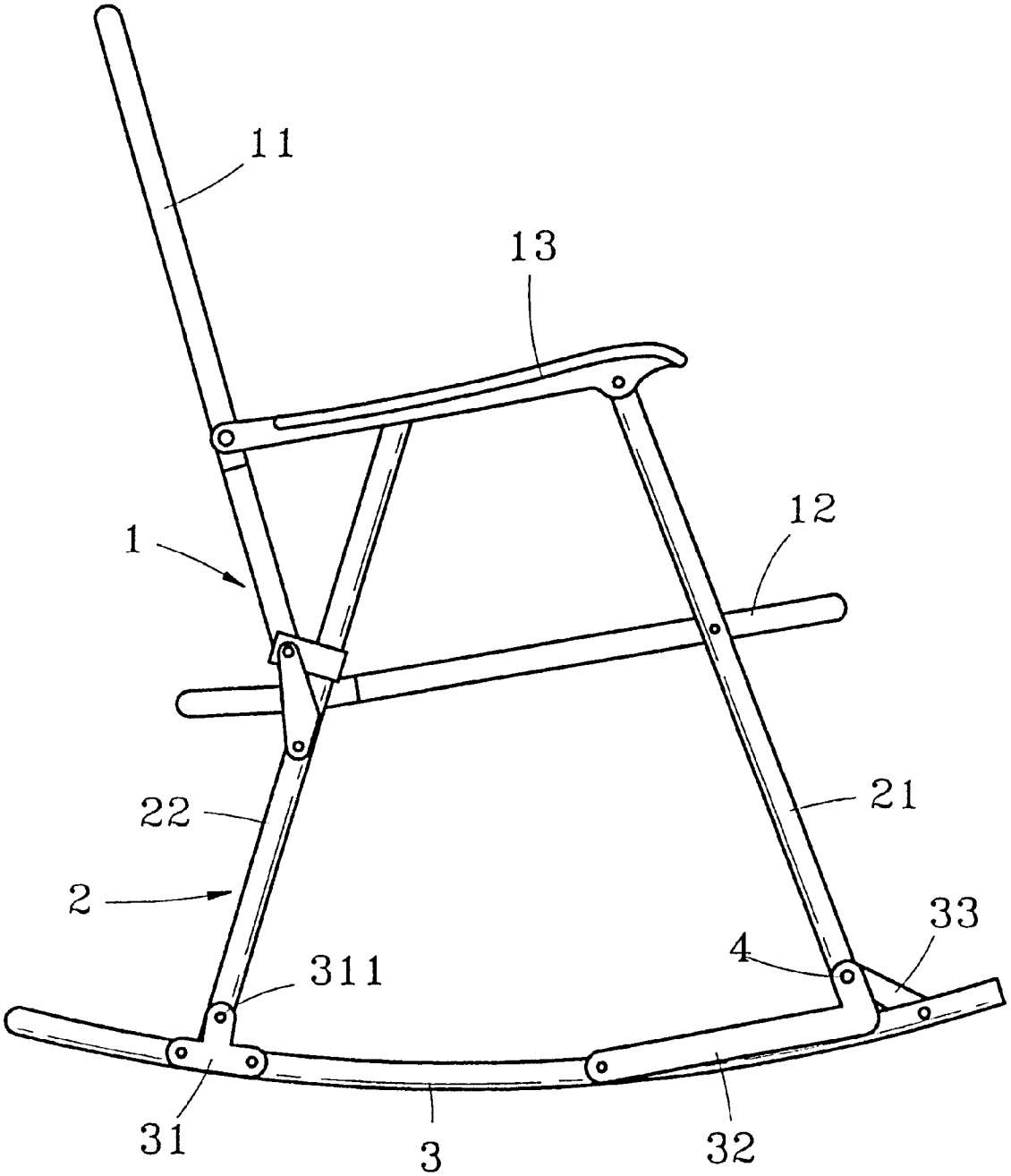
FIG. 2 is a side view of the folding collapsible rocking chair shown in FIG. 1A.

Referring to FIGS. 1A, 1B and 2, a folding collapsible rocking chair is generally comprised of a chair 1, two side frame sets 2 and 2' disposed at two opposite lateral sides of the chair 1, and at least one rocker for example two rockers 3 and 3' fixedly connected in parallel and coupled to the side frame sets 2 and 2' at the bottom.

The chair 1 is comprised of a back 11, a seat 12, and two armrests 13 bilaterally pivoted to the back 11. The back 11 and the seat 12 can be turned relative to each other, and closely attached together.

The side frame sets 2 and 2' each are comprised of a front upright rod 21 and a rear upright rod 22. The front and rear upright rods 21 and 22 each have a top end pivoted to one armrest 13, and a middle part pivoted to the seat 12.

The rockers 3 and 3' each comprise a fixed lug 31 near the rear end pivoted to the bottom end of the rear upright rod 22 of one side frame set 2 or 2' by a pivot 311, a link 32 on the middle, the link 32 having a rear end pivoted to a middle part of the rocker 3 or 3', a front end pivoted to the bottom end of the front upright rod 21 of one side frame set 2 or 2' by a pivot 4, and a retainer rod 41 perpendicularly raised from the front end, and a pivoted hook 33 near the front end, the hook 33 having a hooked portion 331 for hooking on the retainer rod 41 to secure the corresponding upright front rod 21 in place, enabling the corresponding side frame set 2 or 2' to be locked in the operative position.

Figure 3A:
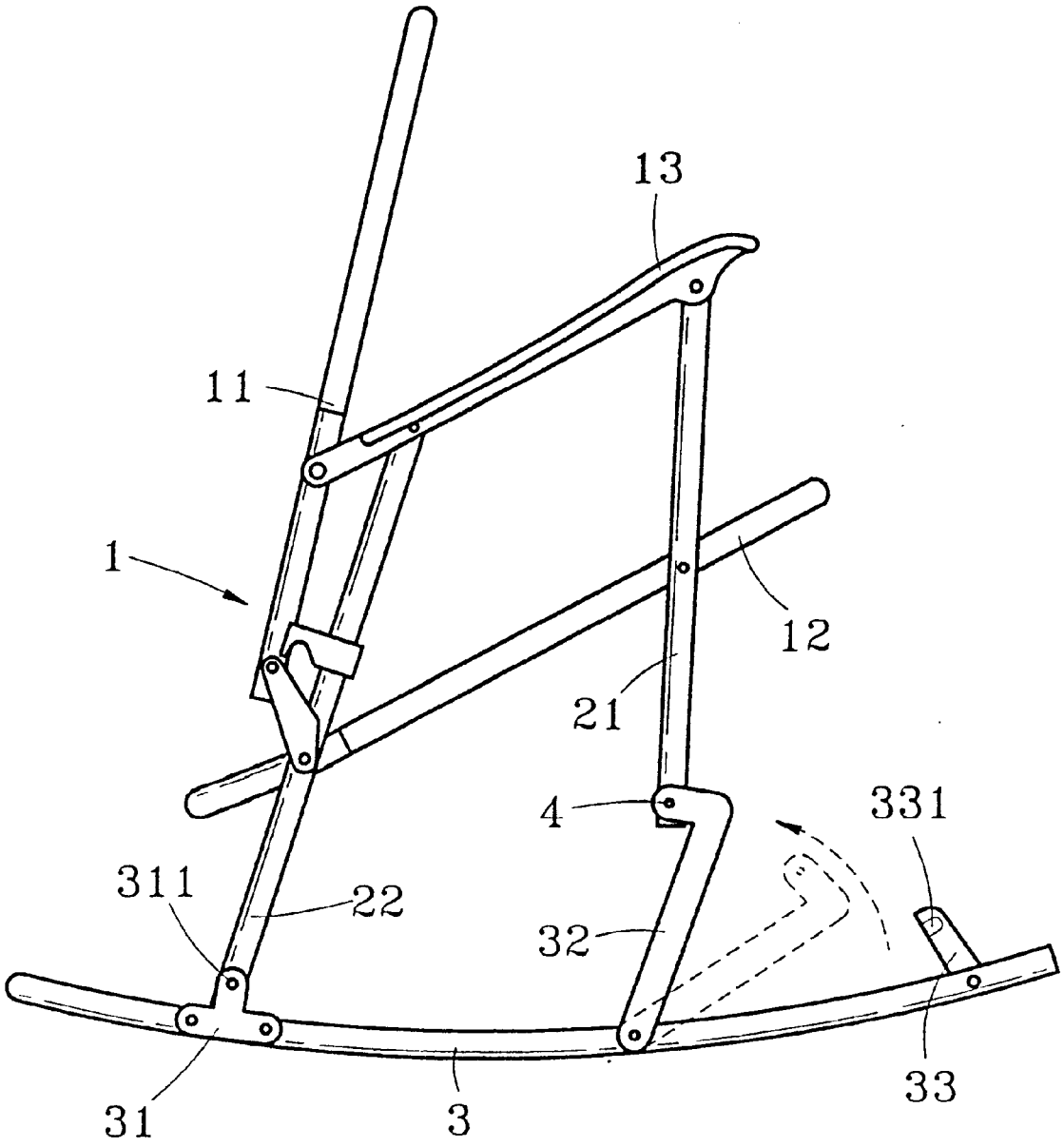
FIG. 3A illustrates the folding collapsing operation of the present invention (Step I).
Figure 3B:
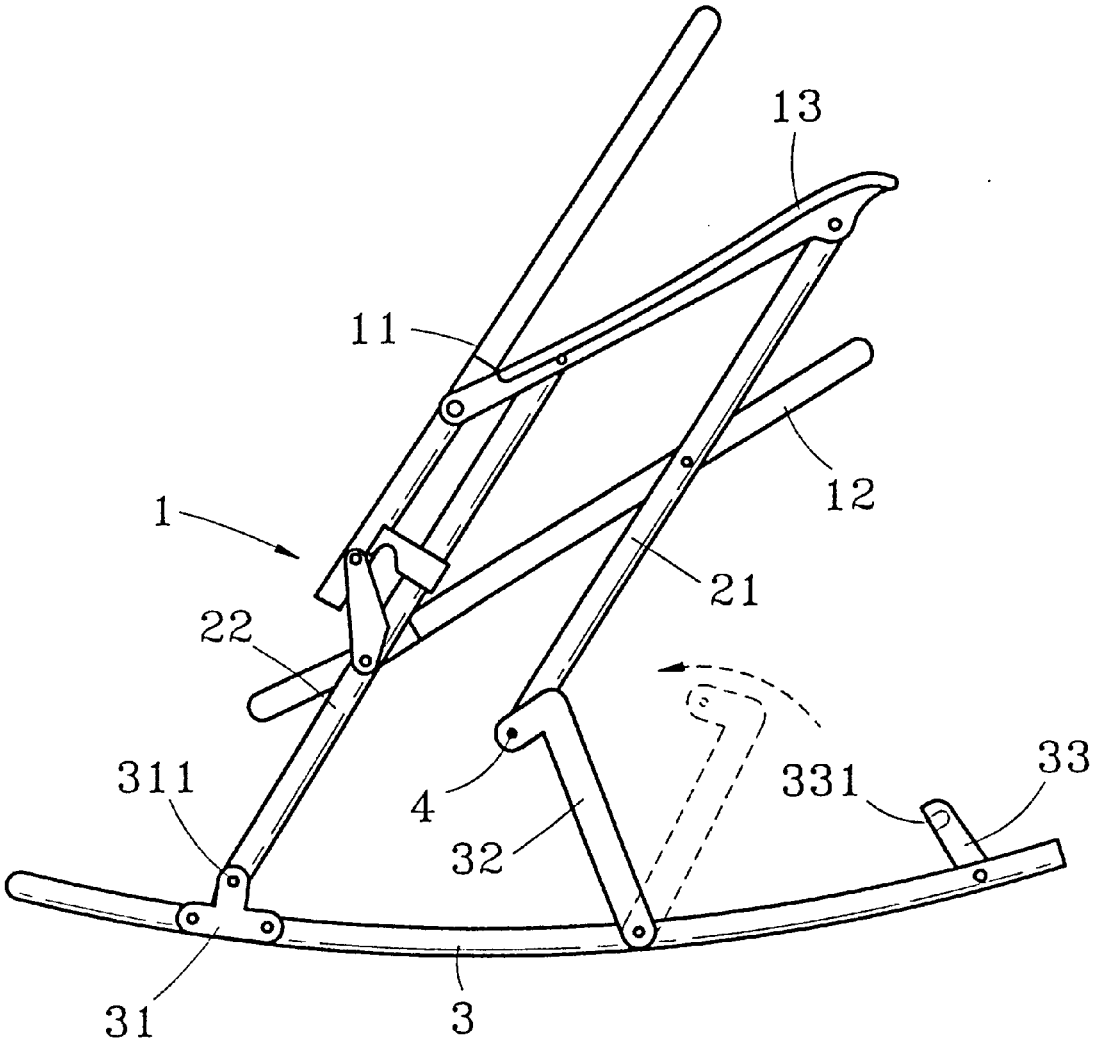
FIG. 3B illustrates the folding collapsing operation of the present invention (Step II).
Figure 4:
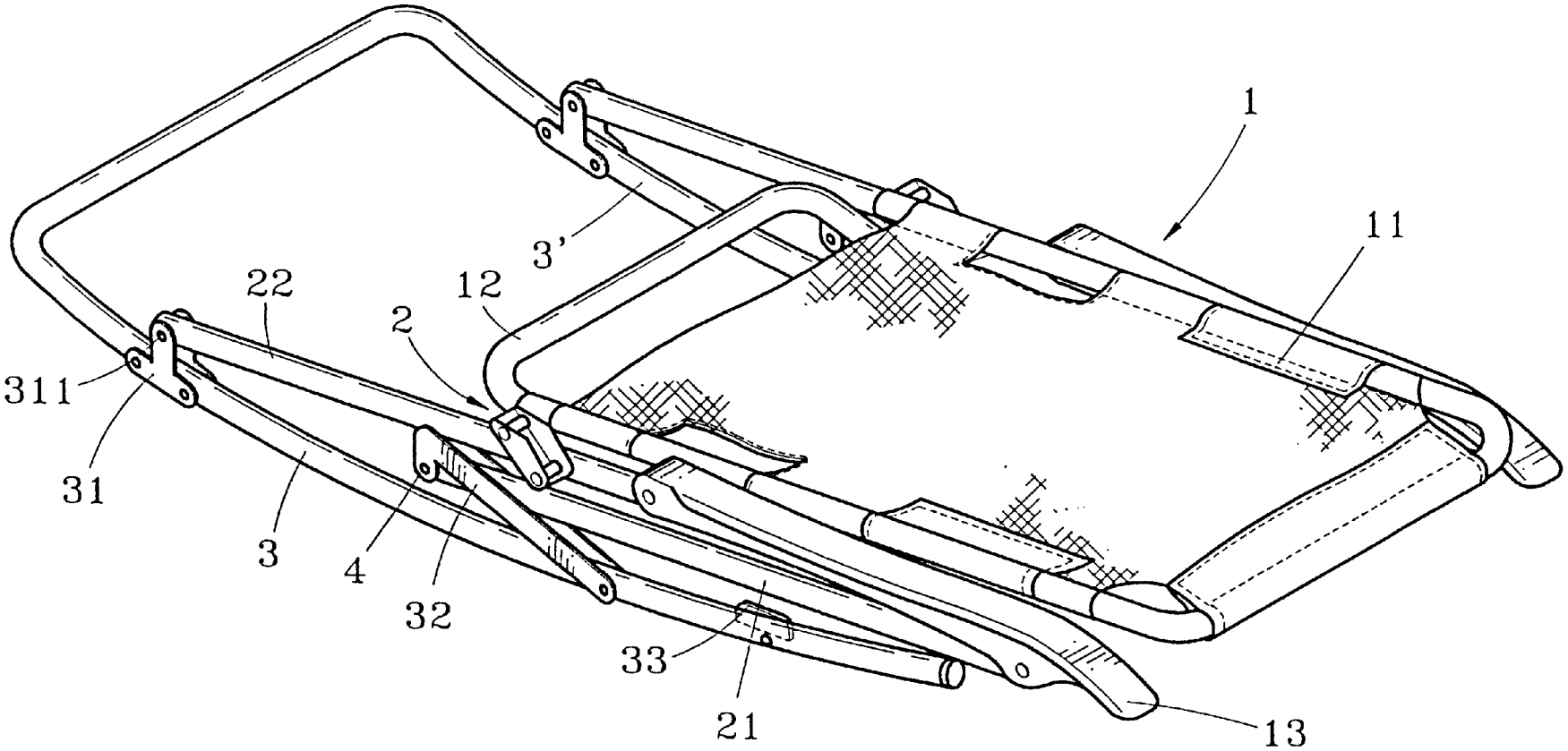
FIG. 4 illustrates the folding collapsible rocking chair collapsed.

Referring to FIGS. 3A, 3B and 4, when the pivoted hooks 33 of the rockers 3 and 3' are respectively disengaged from the respective retainer rods 41, the pivoted hooks 32 can then be turned away from the pivoted hooks 33 (see FIG. 3A), enabling the seat 12 to be turned upwardly backwards toward the back 11 (see FIG. 3B). When the seat 12 and the back 11 are closely attached together, the seat 12 and the back 11 are turned downwards and closely attached to the rockers 3 and 3' (see FIG. 4).

What is claimed is:

1. A folding collapsible rocking chair comprising:

a chair, said chair comprising a back, a seat, and two armrests bilaterally pivoted to said back, said back and said seat being pivoted to each other;

two side frame sets coupled to said chair at two opposite lateral sides, said side frame sets each comprised of a front upright rod and a rear upright rod, said front upright rod and said rear upright rod each having a top end pivoted to one armrest, and a middle part pivoted to said seat; and rocker means coupled to said side frame sets at a bottom side, said rocker means having a rear part pivoted to the rear upright rods of said side frame sets at a bottom side, and a middle part mounted with two links at two opposite sides, said links each having a rear end pivoted to said rocker means and a front end respectively pivoted to the front upright rods of said side frame sets, wherein said links each have a retainer rod perpendicularly raised from the respective front end, and said rocker means comprises two pivoted hooks near a front end thereof respectively hooked on the retainer rods at said links.

2. The folding collapsible rocking chair of claim 1 wherein said rocker means has two fixed lugs bilaterally disposed at the rear part thereof and respectively pivoted to the rear upright rods of said side frame sets by pivot means.

* * * * *